United States Patent [19]

Liebscher et al.

[11] 4,177,533

[45] Dec. 11, 1979

[54] CLEANING DEVICE

[75] Inventors: Johannes Liebscher, Nassau; Rolf G. Schüllein, Singhofen, both of Fed. Rep. of Germany

[73] Assignee: Leifheit International Guenter Leifheit GmbH, Nassau, Fed. Rep. of Germany

[21] Appl. No.: 637,856

[22] Filed: Dec. 4, 1975

[30] Foreign Application Priority Data

Dec. 5, 1974 [DE] Fed. Rep. of Germany ..... 2457414

[51] Int. Cl.[2] ..... A47L 11/33

[52] U.S. Cl. ..... 15/42

[58] Field of Search ..... 15/42, 87, 385

[56] References Cited

U.S. PATENT DOCUMENTS 3,750,215 8/1973 Liebscher ..... 15/42

*Primary Examiner*—Edward L. Roberts

*Attorney, Agent, or Firm*—Michael J. Striker

[57] ABSTRACT

A cleaning device has a main brush which picks up dirt from a surface to be cleaned and deposits it in dirt-collecting receptacles as the cleaning device is moved over the surface to be cleaned. A pair of additional brushes is mounted in corner regions of the housing and delivers dirt toward the main brush. The additional brushes are rotated as the cleaning device is moved over the surface in opposite directions, and they are mounted in bearings for limited pivoting substantially in the opposite directions so that those portions of the bristles of the additional brushes which move toward the main brush are in contact with the surface to be cleaned. A driving wheel rotates the additional brushes in opposite angular directions depending on the direction of movement of the cleaning device, the additional brushes and the driving wheel being partly supported in a main portion of the housing, and partly in a cover which is connected to the main portion of the housing. Each of the additional brushes may be mounted in a sleeve with snap action, the respective sleeve carrying a bevel gear which meshes with a bevel gear mounted at an end portion of a shaft on which the driving wheel is mounted for shared rotation therewith. One of the bearings which supports the sleeve and thus the additional brush is shaped as an elongated opening which extends in the opposite directions or at slight angles thereto toward the center of the cleaning device.

13 Claims, 5 Drawing Figures

CLEANING DEVICE

BACKGROUND OF THE INVENTION

The present invention relates to a cleaning device in general, and more particularly to a cleaning device which includes at least one main brush and an additional brush which delivers dirt to the main brush from regions which are inaccessible to the main brush.

There are already known various cleaning devices of the type here under consideration which devices, in general, include a main brush which is mounted in a housing of the cleaning device for rotation about an axis which is parallel to the surface to be cleaned and extends transversely to the direction of movement of the cleaning device over the surface to be cleaned. In addition thereto, a pair of additional brushes is mounted in the corner regions, preferably front corner regions of the device when considered in the direction of movement thereof, which additional brushes rotate about axes which are substantially normal to the surface to be cleaned. Each such additional brush has an annulus of bristles which extend substantially radially of the axis of rotation of the additional brush and toward the surface to be cleaned.

The additional brushes of conventional cleaning devices are usually driven into rotation in opposite angular directions in response to the movement of the cleaning device in opposite directions over the surface to be cleaned. In order to assure that the additional brushes will pick up dirt from regions without the path of movement of the main brush and deposit it on the surface to be cleaned within such path, it has already been proposed to mount the additional brushes in the housing of the cleaning device for pivoting in response to the change of direction of movement of the cleaning device in the opposite directions so that diametrally opposite regions of the annulus of bristles will respectively come into contact with the surface to be cleaned and deliver the dirt from without to within the path of the main brush.

There is already known a conventional cleaning device of the type here under discussion in which the additional brushes are mounted in the housing of the cleaning device for pivoting between two end positions in one of which one portion of the annulus of bristles when considered with respect to the housing comes into contact with the surface to be cleaned when the cleaning device is moved in one of the opposite directions, while a diametrally opposite portion of the annulus of bristles when considered in relation to the housing comes into contact with the surface to be cleaned when the cleaning device is displaced in the other of the opposite directions. Inasmuch as the pivoting of the additional brush takes place simultaneously with the reversal of the direction of angular displacement thereof, the bristles of the additional brush will always move dirt in the same direction, that is, toward the main brush of the cleaning device. Thus, when the driving and pivoting mechanisms are properly selected, it is achieved that the additional brush is always in contact with the surface to be cleaned in a region of the annulus of bristles which conducts movement in direction toward the main brush and thus to the dirt-collecting receptacles which are arranged alongside the main brush so that the cleaning device effectively cleans the surface irrespective of the direction of movement of the cleaning device over such surface. In this prior-art device, the additional brush is mounted in a bearing body which is mounted in the housing of the cleaning device for pivoting about an axis which extends substantially normal to the direction of movement of the cleaning device over the surface to be cleaned and which is substantially parallel to the surface. The cleaning device of this construction includes a control mechanism which pivots the bearing body relative to the housing of the cleaning device between the above-mentioned end positions in which the respective diametrally opposite portions of the annulus of bristles come into contact with the surface to be cleaned.

Experience with this type of prior-art cleaning device has shown that such device is rather complex and, consequently, expensive, particularly inasmuch as the additional brush is mounted in a separate bearing body which, in turn, is mounted in the housing of the cleaning device for pivoting between the end positions thereof. The multitude of parts which are needed for mounting the cleaning body or brush in the housing of the cleaning device contributes considerably to the complex and expensive manufacture and assembly of the prior art cleaning device of this type.

SUMMARY OF THE INVENTION

Accordingly, it is an object of the present invention to avoid the disadvantages of the prior art cleaning devices.

More particularly, it is an object of the present invention to provide a cleaning device of the type here under consideration which is simple and inexpensive to manufacture and assemble, and reliable in operation.

It is a further object of the present invention to provide a cleaning device of the type having a main brush and additional brushes which deliver dirt to the main brush to be picked up by the latter, in which the number of parts which are needed for mounting the additional brushes is materially reduced compared to the prior art.

It is a concomitant object of the present invention to provide a cleaning device in which it is achieved in a simple and inexpensive way that the additional brushes deliver dirt from without to within an effective path of the main brush independently of the direction of movement of the cleaning apparatus.

Still another object of the present invention is to provide a cleaning device which can be easily assembled and disassembled.

In pursuance of these objects and others which will become apparent hereafter, one feature of the present invention resides, briefly stated, in a cleaning device which is moved in opposite directions over a surface to clean the latter, in a combination which comprises a housing; at least one cleaning body having an axis of rotation and cleaning portions extending substantially radially of the cleaning body; means for so mounting the cleaning body on the housing for rotation about the axis of rotation and for pivoting substantially in the opposite directions relative to the housing that the respective diametrally opposite ones of the cleaning portions contact the surface to be cleaned in response to the movement of the housing in one and the other of the opposite directions, respectively; and means for driving the cleaning body into rotation about the axis of rotation in opposite angular directions in response to the movement of the housing in the opposite directions, whereby the respectively contacting cleaning portions of the cleaning body move over the surface to be cleaned in substantially the same predetermined direction relative to the housing regardless of whether the housing moves in the one or the other of the opposite directions.

According to a currently preferred embodiment of the invention, the mounting means includes two axially spaced bearings for the cleaning body, one of the bearing being enlarged to permit the pivoting of the cleaning body relative to the housing. In this manner, the additional brush, which has a shaft, can be so mounted on the housing that the shaft of the additional brush is directly supported in the bearings which are provided in the housing. Preferably, the opening of the one bearing is enlarged only in the direction of pivoting of the additional brush so that the additional brush is limited to pivoting only substantially in the direction of movement of the cleaning device. When the cleaning device is moved over the surface to be cleaned, friction arising between the surface to be cleaned and the additional brush results in tilting or pivoting of the additional brush in direction opposite to the movement of the cleaning device over the surface to be cleaned, which pivoting occurs simultaneously with the reversal of rotation of the additional brush in response to the reversal of movement of the cleaning device over the surface to be cleaned so that always that portion of the annulus of bristles of the additional brush which extends frontwardly when considered in the direction of instantaneous movement of the cleaning device over the surface to be cleaned, comes into contact with the surface to be cleaned, such portion of the annulus of bristles always moving in direction toward the center of the cleaning device and thus from without to within the effective path of the main brush of the cleaning device.

In a currently preferred embodiment of the present invention, one of the bearings which support the shaft of the additional brush is formed with an elongated opening which extends substantially in the direction of movement of the cleaning device over the surface to be cleaned. In this manner, it is achieved that the additional brush will pivot or tilt, together with its shaft, only in the desired direction.

According to a further currently preferred concept of the present invention, the one bearing which has the elongated opening is arranged adjacent to the annulus of bristles, that is, it is closer to the surface to be cleaned than the other bearing. In this manner, the pivoting movement of the additional brush is greatly facilitated inasmuch as the additional brush can pivot about the free end of the shaft of the additional brush.

It has been found to be advantageous if the shaft of the additional brush includes a driving sleeve into which a central projecting portion of the brush body of the additional brush is inserted and in which it is retained with snap action. When the driving sleeve, in this manner, constitutes a part of the shaft of the additional brush, the construction of the cleaning device is further simplified, particularly due to the fact that the driving sleeve shares the pivoting movement of the additional brush.

According to a further advantageous feature of the present invention, the end of the driving sleeve which is remote from the annulus of bristles is received in the other of the bearings for supporting the additional brush in the housing of the cleaning device, the other bearing having an opening of a substantially cup-shaped configuration and being provided in and connected to the housing of the cleaning device. In this manner, the driving sleeve which pivots together with the additional brush is supported at its free end in a portion of the housing.

In order to render the pivoting of the driving sleeve together with the additional brush possible, the cup-shaped opening in the other bearing conically diverges in direction toward the one bearing and thus toward the annulus of bristles, and the outer diameter of the driving sleeve substantially corresponds to the smallest inner diameter of the conically shaped opening of the other bearing. In this manner, the additional brush can pivot about the free end of the sleeve without being hampered in its pivoting by the walls bounding the opening in the other bearing.

The central projecting portion of the additional brush may have a section which projects beyond the free end of the sleeve and engages behind the same, and the other bearing for the free end of the driving sleeve may be provided with an aperture which communicates with the opening of the other bearing and in which the projecting section of the central portion of the additional brush is accommodated. The projecting section of the central portion of the additional brush may be provided with projections which engage behind the free end of the driving sleeve and thus connect the additional brush of the driving sleeve, and may be slotted in the axial direction of the projecting portion of the additional brush so that the projecting section can be elastically compressed for passage through the sleeve, in transverse direction thereof, but will engage behind the end portion of the driving sleeve once the projecting section passes through the sleeve so that the projections will engage behind the free end of the sleeve. In this manner, the additional brush is connected to the driving sleeve in an exceedingly simple and reliable manner.

It is also currently preferred that the one bearing which is formed with the elongated opening and which accommodates the end of the driving sleeve which is adjacent to the annulus of bristles of the additional brush be formed in a cover which is releasably connected to the main portion of the housing of the cleaning device. The cover closes a compartment which accommodates an arrangement for driving the sleeve into rotation, and the assembly of the cleaning device is facilitated by providing the releasably connectable cover inasmuch as the latter closes the above-mentioned compartment in direction from the surface to be cleaned and reliably holds all of the transmission and other parts for driving the driving sleeve in their respective proper positions relative to one another.

In order to restrict the movement of the driving sleeve in its axial direction so as to assure its proper position relative to the transmission and to the housing, the end of the driving sleeve which is received in the elongated opening of the one bearing has provided adjacent thereto a shoulder which bears against the region of the cover which surrounds the elongated opening of the one bearing member. It is obtained in this manner that the driving sleeve is mounted in the housing, between the main portion thereof and the cover, for rotation, and is simultaneously prevented from displacement axially thereof.

According to a further advantageous concept of the present invention, the additional brush is provided with a circumferentially extending depression at its side which faces the housing, and the cover may have a projection which carries the one bearing and which extends into the depression of the additional brush. This construction of the additional brush and of the cooperating cover materially reduces the dimensions of the cleaning device, particularly in direction normal to the surface to be cleaned. This is particularly due to the fact that part of the driving sleeve and some additional parts of the transmission for driving the driving sleeve are received in the depression of the additional brush. When the cleaning device has two additional brushes each of which is arranged in one lateral region of the cleaning device when considered in the direction of movement of the cleaning device over the surface to be cleaned, both of the additional brushes can be driven into rotation from a driving wheel which is arranged intermediate the two additional brushes. The driving wheel may be mounted on a shaft, having one or two sections, for shared rotation therewith, and a bevel gear transmission may be interposed between the shaft of the driving wheel and the driving sleeves of the additional brushes. In this manner, only one driving wheel is needed for driving both additional brushes into rotation about their respective axes, which further reduces the expenses involved in constructing and assembling the cleaning device of the present invention.

In a currently preferred embodiment of the present invention, the driving wheel has support portions at two axial sides thereof, and the housing has bearings which mount the support portions of the driving wheel in the housing for rotation. Preferably, the bearings for the support portions of the driving wheel are partly provided in the main portion of the housing, and partly in a cover which closes the compartment accommodating the driving wheel and provided with a slot through which the driving wheel extends from the interior of the housing to the exterior thereof. In this manner, the driving wheel is reliably mounted in the housing of the cleaning device, and the assembling operation of the cover with the main portion of the housing is very simple.

Preferably, the driving wheel has an axial opening of a non-circular configuration, and the shaft on which the driving wheel is mounted for shared rotation therewith has at least one portion of corresponding non-circular cross-section which is received in the opening of the driving wheel. It is currently preferred that the shaft have two sections, each of which has one end portion of non-circular cross section which is received in the non-circular opening of the driving wheel. In view of the fact that in this embodiment of the present invention the free end portions of the shaft sections are simply inserted into the central opening of the driving wheel and thus mounted therein for shared rotation with the driving wheel, the assembly of the shaft sections with the driving wheel is greatly facilitated.

In a further currently preferred embodiment of the present invention, each of the shaft sections has an end portion which is spaced from the driving wheel, and a bevel gear is formed at each of such spaced end portions of the shaft sections. Each of the bevel gears meshes with an additional bevel gear which is formed on the driving sleeve of the additional brush. The bevel gear provided at the end portion of the shaft has an abutment surface which abuts against a partitioning wall within the housing to prevent axial displacement of the shaft section. In this manner, the driving wheel is reliably operatively connected with the respective driving sleeves of the additional brushes, and the bearing of the abutment surfaces of the respective bevels against the partitioning wall of the housing prevents axial movement of the shaft sections on which the driving wheel is mounted for shared rotation therewith.

Advantageously, the main portion of the housing may have a partial bearing formed therein, and a cover for the main portion of the housing can be provided with a complementary partial bearing for each of the shaft sections. Advantageously, the partial bearings are provided in partitioning walls of the housing main portion and the cover, respectively. In this manner, the shaft section is reliably supported in the housing at its end which is adjacent to the bevel gear carried by the end portion of the shaft section. The assembly of the cleaning device of the present invention is facilitated by the provision of the bearings for the shaft sections in the main portion of the housing and in the cover, respectively, in that the shaft section for each of the additional brushes can be simply placed into the bearing part which is provided in either the main portion of the housing or in the cover, and is held by both bearing parts when the cover is assembled with the main housing portion.

It is proposed according to a further advantageous concept of the present invention that the cover for the main housing portion extend transversely of the housing over substantially the entire width thereof so that the cover simultaneously serves for supporting the additional brushes and the sleeves thereof, the driving wheel, the shaft sections of the driving wheel, and the respective bevel gears of the bevel gear transmission between the driving wheel and the driving sleeves of the additional brushes. In this manner, when the cleaning device of the present invention is to be assembled, it is only necessary to accommodate the various parts in the main housing section and then to attach the cover to the main housing section, whereupon the driving wheel, the two shaft sections, the two bevel gear transmissions and the two additional brushes are simultaneously reliably mounted in their proper positions relative to the housing.

According to a further advantageous proposal of the present invention, the cover and the main housing portion may be provided with cooperating connecting elements which engage one another with snap action. It is currently preferred that the main housing portion have a plurality of projecting elements, and that the cover be formed with resiliently yieldable connecting elements which receive the projections of the main housing portion between them and engage them with snap action. In this manner, the cover is simply and reliably connected to the main housing portion when the connecting elements engage the projecting portions with snap action. This simple arrangement of connecting elements eliminates the need for providing other connecting arrangements, such as screws, rivets or similar connecting elements.

According to a further currently preferred concept of the present invention, an aperture can be provided between each pair of the connecting elements mounted on the cover. When such apertures are provided, it is very simple to disassemble the cover from the main housing portion by inserting a screwdriver or a similar member into the aperture so as to disengage the connecting elements from the respective projecting portions of the main housing portion.

Finally, it is also proposed according to a further aspect of the present invention to so shape the elongated opening of the one bearing member which is provided in the cover and which serves for supporting the shaft of the additional brush, as to extend at a slight angle with respect to the direction of movement of the cleaning device over the surface to be cleaned toward the center of the cleaning device. Preferably, the elongated opening has two end portions each of which define a major axis inclined at a small angle relative to the assigned direction of movement of the cleaning device. It is achieved in this manner that when the cleaning device of the present invention is operated in the proper way, it is not the portion of the annulus of bristles directed frontwardly of the additional brush when considered in the direction of movement of the cleaning device, which is in contact with the surface to be cleaned, but rather that portion of the annulus of bristles which is somewhat offset in direction toward the adjacent lateral portion of the cleaning device. In this manner, dirt is removed not only from both regions of the surface to be cleaned which are located frontwardly of the cleaning device of the present invention, but also from regions which are located laterally of the cleaning device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
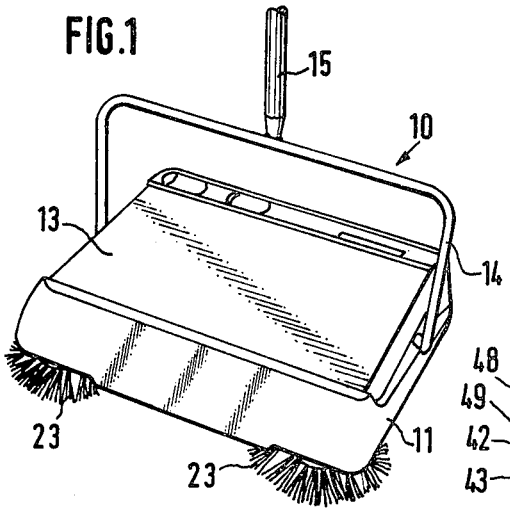
FIG. 1 is a perspective view of a cleaning device according to the present invention equipped with additional brushes.

Referring now to the drawings, and first to FIG. 1 thereof, it may be seen that a cleaning device of the present invention which is designated in toto with a reference numeral 10 includes a housing 11 which, in a conventional manner, includes a circumferential frame 12, and an upper portion 13 which closes the frame 12 from above. The frame 12 is provided with bearings for receiving a bracket 14, to which there is connected an elongated handle 15 which serves the purpose of moving the cleaning device 10 over the surface to be cleaned.

Figure 2:
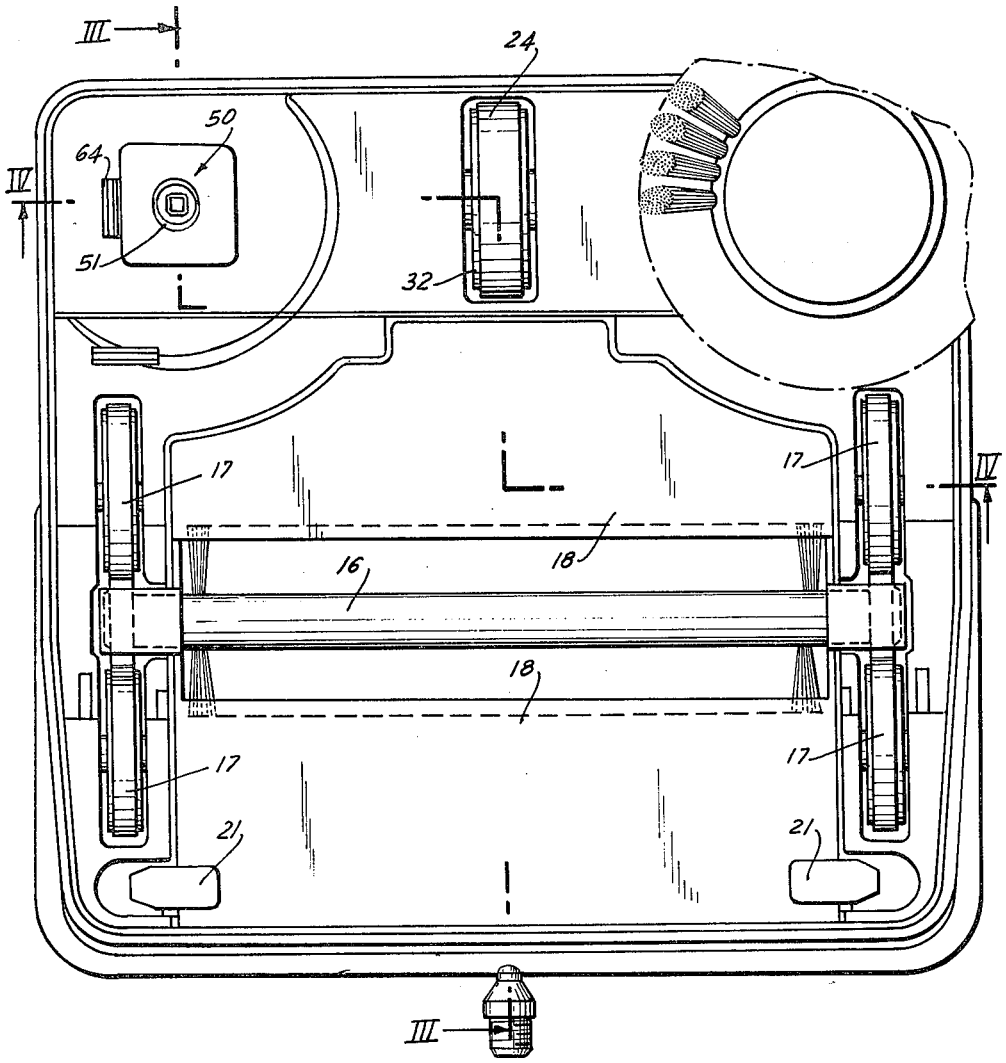
FIG. 2 is a bottom plan view of the device of FIG. 1 with one of the additional brushes removed.

As clearly seen in particular in FIG. 2, at least one main brush 16 is mounted in the frame 12 for rotation about an axis which is transverse to the housing 11. Driving wheels 17 are also mounted in the frame 12 of the housing 11, which driving wheels 17 serve the purpose of supporting the housing 11 on the surface to be cleaned during the movement of the cleaning device 10 and also for driving the rotary main brush 16. As apparent from the comparison of FIGS. 2 to 4, the main brush 16 is substantially cylindrical and the bristles thereof extend into contact with the surface to be cleaned. The cylindrical main brush 16 picks up dirt from the surface during the movement of the cleaning device 10. Driving wheels 17 which are mounted in the frame 12 for rotation are arranged in pairs adjacent to the shaft of the cylindrical main brush 16 and are in frictional contact with the shaft so as to drive the cylindrical main brush into rotation about its axis. At both sides of the cylindrical main brush 16, there are provided in the housing 11 dirt-collecting receptacles 18, and the dirt picked up by the main brush 16 is deposited into the receptacles 18. Each of the dirt-collecting receptacles 18 includes a bottom flap 19 which is mounted in the housing 11 for pivoting about an axle 20. The bottom flap 19 is held in its operative position, in which the free end of the bottom flap 19, which is provided with projections 21 simultaneously serving the purpose of opening the flap 19, abuts against the lower region of the frame 12, a spring 66 holding the bottom flap 19 in such an operative position. The main brush 16 is accommodated in an opening 22 between the two bottom flaps 19. Inasmuch as one of the dirt-collecting receptacles 18 is arranged forwardly of and the other rearwardly of the main brush 16 when considered in the direction of movement of the cleaning device 10, the dirt picked up by the main brush 16 will be deposited into one of the dirt-collecting receptacles 18 depending on the direction of movement of the cleaning device 10 over the surface to be cleaned. Inasmuch as the reversal of movement of the cleaning device 10 over the surface to be cleaned results in simultaneous reversal of the direction of rotation of the main brush 16, the dirt picked up by the main brush 16 will always be collected by one of the receptacles 18 for the same direction of movement of the cleaning device 10 over the surface to be cleaned.

In view of the fact that the cylindrical main brush 19 is effective for picking up dirt only within a predetermined path the width of which corresponds to the longitudinal dimension of the main brush 16, the main brush 16 is unable to collect dirt from such regions of the surface to be cleaned which are outside such a path. This is particularly noticeable in corner regions of the surface to be cleaned, from which corner regions the main brush 16 by itself is incapable of removing dirt. Therefore, additional brushes 23 are provided which are active for removing dirt from such regions of the surface to be cleaned which are located outside the effective path of the main brush 16. By providing the additional brushes 23, it is possible to remove dirt also from corner regions of the surface to be cleaned and from underneath any projecting portions which extend above such corner regions.

In the illustrated embodiment of the present invention, one additional brush 23 is mounted at each of the front corner regions of the cleaning device 10. Each of the additional brushes 23 is mounted for rotation about an axis which is substantially normal to the surface to be cleaned when the cleaning device 10 is in operation, the respective additional brush 23 having an annulus of bristles which extend substantially outwardly of the axis of rotation of the additional brush 23, which bristles extend toward contact with the surface to be cleaned and outwardly beyond the effective path of the cylindrical main brush 16 and also beyond the lateral and front portions of the housing 11 of the cleaning device 10.

Each of the additional brushes 23 is driven into rotation about its respective axis of rotation so that the bristles thereof contact the surface to be cleaned and deliver dirt from regions outside the path of the main brush 16 to within the path. A driving wheel 24 is arranged between the two additional brushes 23, the driving wheel 24 being in contact with the surface to be cleaned, the driving wheel 24 being in driving connection with the additional brushes 23. The driving wheel 24 and the two additional brushes 23 are accommodated in a space 25 which is provided in the front region of the cleaning device 10, the space 25 being closable by means of a cover 26. The space 25 is separated from the dirt-collecting receptacles 18 by means of a partitioning wall 27. As seen most clearly in FIG. 4, the driving wheel 24 is formed at both axial sides thereof with support portions 28 which are partially received in bearings 29 which are provided in a partitioning wall 30 of the housing 11. Projections 31 of the cover 26 complement the partial bearings 29 of the housing 11 to a complete bearing for the respective support portion 28 of the driving wheel 24. The cover 26 is formed with a slot 32 through which the driving wheel 24 extends from the interior of the housing 11 to its exterior.

The driving wheel 24 has an axial opening 33 of a non-circular cross-section. End portions 34 of shaft sections 35 which connect the driving wheel 24 with the additional brushes 23 are inserted from the two sides of the driving wheel 24 into the opening 33, the end portions 34 having cross-sections corresponding to the cross-section of the opening 33 so that the shaft sections 35 are mounted on the driving wheel 24 for shared rotation therewith. Each of the shaft sections 35 is formed with a bevel gear 36 at its end which is remote from the driving wheel 24. Each of the bevel gears 36 meshes with an additional bevel gear 37 which is formed on a driving sleeve 38.

Figure 3:
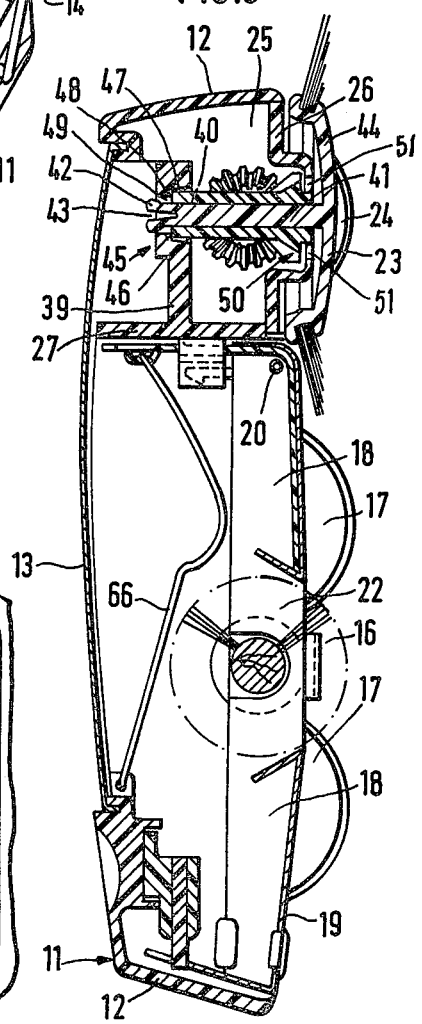
FIG. 3 is a cross-sectional view taken on line III—III of FIG. 2.
Figure 4:
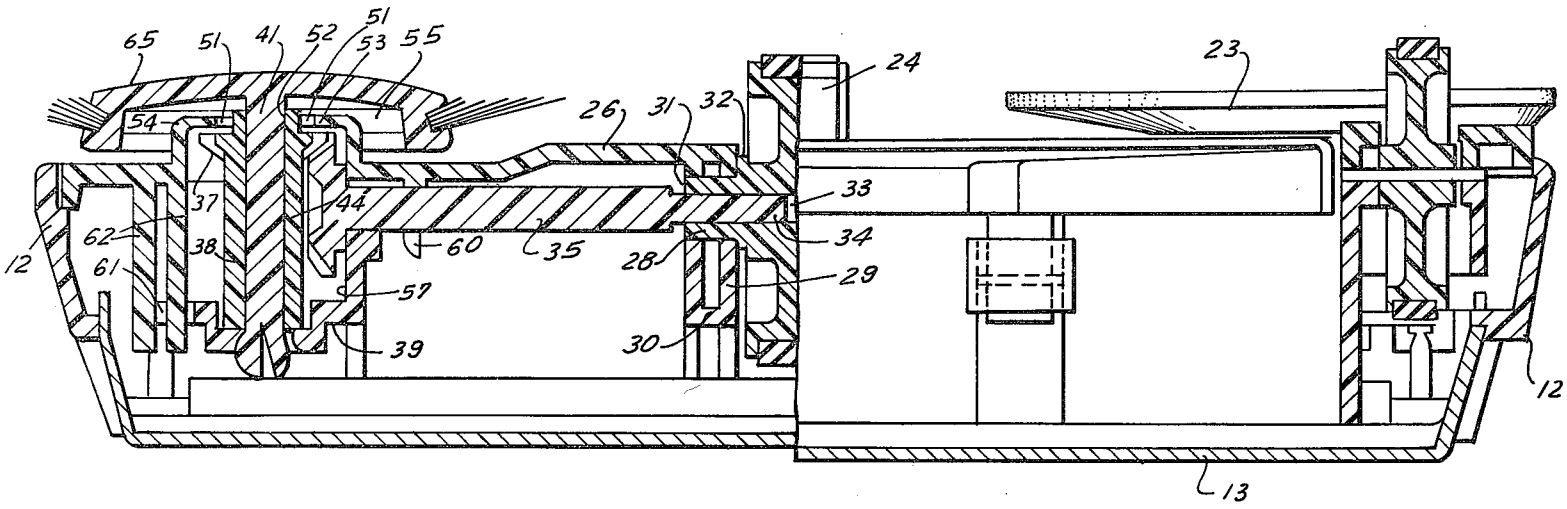
FIG. 4 is a cross-sectional view taken on line IV—IV of FIG. 2.

Referring now more particularly to FIGS. 3 and 4 of the drawings, it may be seen that the driving sleeve 38 is supported for rotation in a part of the housing 11 which defines a transmission compartment 39, the driving sleeve 38 extending substantially normal to the surface to be cleaned. The driving sleeve is formed with an opening 40 which extends longitudinally of the sleeve 38, and a projecting portion 41 of the additional brush 23 is received in the opening 40 of the driving sleeve 38. The projecting portion 41 of the additional brush 23 is received in the opening 40 for limited movement in the axial direction of the sleeve 38 but for shared rotation therewith. The projecting portion 41 of the additional brush 23 has a free end section which is enlarged at 42 so that the radial dimension of the enlarged portion 42 exceeds the inner diameter of the opening 40 of the driving sleeve 38. An axially extending slot 43 is provided in the enlarged section 42 of the projecting portion 41, which slot 43 permits elastic yielding of the enlarged section 42 radially inwardly of the projecting portion 41 so that the projecting portion 41 of the additional brush 23 is able to pass through the opening 40 of the driving sleeve 38, under simultaneous elastic yielding of the enlarged portion 42 into the slot 43. When the enlarged portion 42 clears the opening 40 of the sleeve 38, it returns to its non-compressed position and engages behind the free end of the sleeve 38 and thus secures the additional brush 23 to the driving sleeve 38. In this connection, it is to be mentioned that the length of the projecting portion 41 of the additional brush 23 measured between the enlarged section 42 and a body 44 of the additional brush 23 is slightly larger than the driving sleeve 38 so that the additional brush 23 is able to change its position axially of the driving sleeve 38 in order to compensate for eventually present unevenness of the surface to be cleaned.

The driving sleeve 38 has a free end which is remote from the body 44 of the additional brush 23, which free end is substantially cylindrical and received in a bearing 45 which is formed with a substantially cup-shaped opening 46. The cup-shaped opening 46 is formed in the wall 39 of the transmission compartment formed in the housing 11 of the cleaning device 10. The opening 46 of the bearing 45 conically diverges in direction toward the additional brush body 44 as indicated at 47. Preferably, the outer diameter of the driving sleeve 38 substantially corresponds to the smallest inner diameter of the conically diverging opening 46. The bearing 45 has a bottom portion 48 which is formed with an aperture 49 into which an end of the projecting portion 41 of the additional brush 23 which extends beyond the driving sleeve 38 is received. Due to the fact that the opening 46 has a substantially conical configuration, it is provided for a limited pivoting of the driving sleeve 38 and thus of the additional brush 23 relative to the housing 11 in a manner which is yet to be described.

The driving sleeve 38 is further mounted in a second bearing 50 which is provided in the cover 26. The bearing 50 is formed with an elongated opening 51. The elongated opening 51 extends substantially in the direction of movement of the cleaning device 10 over the surface to be cleaned.

The dimensions of the elongated opening 51 are such that the driving sleeve 38 can pivot forwardly and rearwardly from a central position by approximately 1 mm. The end of the driving sleeve 38 which cooperates with the elongated opening 51 has a substantially cylindrical portion 52 which is reduced in diameter relative to the remainder of the sleeve 38, thus forming a shoulder 53 of annular configuration which abuts against the cover 26 in a region of the elongated opening 51 of the bearing 50. In this manner, the driving sleeve 38 is reliably supported in the transmission compartment 39. It is very simple to mount the driving sleeve 38 in the transmission housing 39 inasmuch as the sleeve 38 is only to be inserted in the transmission compartment 39 and then the cover 26 is to be connected to the housing 11.

The cover 26 is provided in the region thereof forming the bearing 50 with a projection which extends into a depression 55 formed in the body 44 of the additional brush 23. In this manner, the height of the cleaning device 10 is reduced.

As already mentioned before, the shaft sections 35 are formed, at their ends which are remote from the driving wheel 24, with bevel gears 36 which mesh with the additional bevel gears 37 provided on the respective driving sleeve 38. The bevel gear 36 which is provided on the shaft section 35 has an abutment surface 56 at its rear side, and abuts with this abutment surface 56 against an internal partitioning wall 57 of the transmission compartment 39. In this manner, the bevel gear 36 with the shaft section 35 carrying the same is reliably prevented from conducting axial movement. The transmission compartment 39 is provided with a depression 58 for receiving the shaft section 35. The cover 26 which closes the transmission compartment 31 at its side facing the surface to be cleaned has a partitioning wall 59 arranged adjacent to the transmission compartment 39 which partitioning wall 59 is formed with an open bearing depression 60. The shaft section 35 is received and reliably supported in a bearing which includes the two bearing depressions 58 and 60.

The cover 26 which extends over substantially the entire width of the cleaning device 10 thus supports the driving wheel 24, the two shaft sections 35 and the driving sleeves 38. The cover 26 is provided at its end regions with a pair of arresting arms 62 which are provided with projections 61 which extend toward one another. The arresting arms 62 form portions of the cover 26, and embrace holding elements 63 of the transmission compartment 39 in engagement therewith and thus connect the cover 26 to the housing 11 of the cleaning device 10. Thus, for the various above-discussed parts to be supported in the housing 11, it is merely necessary to press the cover 26 against housing 11, whereby the arresting arms 50 to releasably engage the holding projections 63. Apertures 64 are provided in the cover 26 between each of the associated arresting arms 62 of a pair so that a screwdriver or a similar implement can be passed through the respective opening 64 from the exterior into the interior of the housing so as to act on the arresting arms 62 to disociate them from their engagement with the holding portions 63, upon which the cover 26 can be taken off from the housing 11.

The additional brush body 44 is formed with a substantially spherical portion 65. The spherical portions 65 of the additional brushes 23 are in contact with the surface to be cleaned. In this manner, when the cleaning device 10 is moved in the respective direction, and particularly when the direction of movement of the cleaning device 10 is reversed, friction between the additional brush body 44 and the surface to be cleaned retards the movement of the additional brush 23 so that the additional brush 23 tilts to a certain extent permitted by the elongated opening 51 relative to the housing 11 in direction opposite to the direction of movement of the cleaning device 10. In this manner, when the annulus of bristles is arranged as discussed previously, that portion of the annulus of bristles which is instantaneously located in front when considered in the direction of instantaneous movement of the cleaning device 10 comes into effective cleaning contact with the surface to be cleaned whereas the portion of the annulus of bristles which is in the rear when considered in the direction of instantaneous movement of the cleaning device 10 is lifted off the surface. Inasmuch as the driving wheel 24 drives the additional brush in opposite angular directions depending upon the direction of movement of the cleaning device 10 over the surface to be cleaned, always that region of the annulus of bristles of the additional brush 23 is in effective cleaning contact with the surface to be cleaned which moves toward the center of the cleaning device 10, whereby dirt is picked up by the additional brushes 23 from corner regions which are located outside the effective path of the main brush 16 to within such a path so that the cylindrical main brush 16 picks up such dirt and deposits the same into one or the other of the dirt-collecting receptacles 18. When the cleaning device 10 is moved in mutually opposite directions of the surface to be cleaned, the various components of the cleaning device 10 rotate in opposite directions in response to the movement of the cleaning device 10 in one or the other of the directions of movement thereof. As far as the additional brushes 23 are concerned, not only is the direction of angular movement thereof reversed with each reversal of movement of the cleaning device 10 over the surface to be cleaned, but simultaneously a diametrally opposite portion of the annulus of bristles comes into contact with the surface to be cleaned, which portion always moves toward the center of the housing 11 so that in each of the movement phases of the cleaning device 10 over the surface to be cleaned, dirt is engaged by the respective portions of the annulus of bristles of the additional brush 23 and forwarded toward the main brush 16, which main brush 16 then picks up such dirt and deposits it in one or the other of the dirt-collecting receptacles 18. In view of the fact that a pair of additional brushes 23 is arranged on the housing 11 in a mirror-symmetrical fashion, each of the additional brushes 23 being arranged in one front corner region of the cleaning device 10, such regions of the surface to be cleaned which are located outside of the effective path of the main brush 16 can be effectively cleaned by the additional brushes 23, which regions are located to both sides of the effective path of the main brush 16 and also frontwardly thereof.

Figure 5:
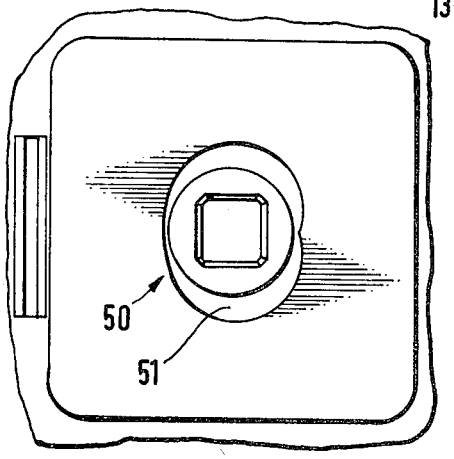
FIG. 5 is a bottom plan view of a portion of the cleaning device showing a modified embodiment of the present invention.

In the embodiment illustrated in FIG. 5, the bearing 50 for the driving sleeve 38 is formed with an elongated opening 51 which, contrarily to what has been described above, does not extend only in the direction of movement of the cleaning device 10 over the surface to be cleaned. Rather, the elongated opening 51 of this embodiment is shaped. Preferably, the elongated opening 51 has end portions each of which defines a major axis inclined at a slight angle to the assigned direction of movement of the cleaning device 10. In this manner, it is achieved that the region of the annulus of bristles of the additional brush 23 which is in the most effective contact with the surface to be cleaned is shifted slightly to the lateral side of the cleaning device 10. Therefore, even those portions of the annulus of bristles of the additional brush 23 which are most remote from the housing 11 in the lateral direction come into contact with the surface to be cleaned to remove dirt therefrom.

It will be understood that each of the elements described above, or two or more together, may also find a useful application in other types of constructions differing from the types described above.

While the invention has been illustrated and described as embodied in a cleaning device, it is not intended to be limited to the details shown, since various modifications and structural changes may be made without departing in any way from the spirit of the present invention. So, for instance, only one additional brush may be provided in only one of the corner regions of the cleaning device or, on the other hand, more than two of such additional brushes may be provided. Also, the additional brushes may be distributed or located in a different manner than in the above-discussed example. It is also possible to construct the housing of the cleaning device in a different manner, and to use different dirt-collecting receptacles or arrange them differently from what has been discussed above. Finally, the shaft of the additional brush, instead of being mounted in two separate bearings, may be mounted in a single bearing, in which event the central opening of the single bearing diverges from its inner to its outer end so as to enable the additional brush to pivot in the above-disclosed manner.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a cleaning device including a housing adapted for movement in two opposite directions over a one cleaning body having an upwardly directed shaft and a ring of radially downwardly directed bristles; a pair of vertically spaced bearings provided in said housing for rotatably supporting said shaft, one of said bearings defining an elongated opening the major axis of which is oriented in the direction of movement of said housing to permit the pivoting of said shaft about a pivot point defined by the other bearing and thus, in response to a change in the direction of movement of said housing, alternately tilting one of two opposite positions of said ring of bristles into engagement with said surface; and driving means for imparting rotary movement to said shaft in a direction dependent on the direction of movement of said housing.

2. A combination as defined in claim 1, wherein said one bearing is adjacent said cleaning body.

3. A combination as defined in claim 2, wherein a bottom part of said housing has a removable cover; and wherein said one bearing is connected to said cover.

4. A combination as defined in claim 3, wherein said sleeve has a substantial cylindrical lower end portion supported in said one bearing, and an enlarged portion adjacent said cylindrical portion and defining an abutment shoulder; wherein said abutment shoulder abuts against the inner wall of said cover to restrict axial movement of said sleeve.

5. A combination as defined in claim 3, wherein said cleaning body is formed with a depression; and wherein said cover has a projecting portion which surrounds said one bearing and extends into said depression of said cleaning body.

6. A combination as defined in claim 1, wherein said driving means includes a driving wheel mounted in said housing for rotation in contact with the surface and driven into rotation in response to movement of said housing over the surface, and transmission means interposed between said driving wheel and said cleaning body and said additional cleaning body, respectively.

7. A combination as defined in claim 6, wherein said driving wheel is mounted on a horizontal shaft for shared rotation therewith; and meshing bevel gears on said horizontal shaft and said shaft connected to said cleaning body.

8. A combination as defined in claim 7, wherein said driving wheel has substantially cylindrical support protions; and wherein said housing has partitioning walls formed with bearings for said support portions of said driving wheel.

9. A combination as defined in claim 1, wherein said elongated opening is formed in the wall of said housing.

10. A combination as defined in claim 9, wherein said elongated opening is formed by two end regions each defining a major axis which is inclined at a small angle with respect to the assigned direction of movement of said cleaning device.

11. A combination as defined in claim 1, wherein said shaft includes a sleeve engaging said bearings and a center axle connected at one end to said cleaning body and extending into said sleeve to rotate therewith.

12. A combination as defined in claim 11, wherein said sleeve has a cylindrical end portion remote from said cleaning body; and wherein the other of said bearings has an opening which receives said cylindrical end portion of said sleeve and is of a generally cup-shaped configuration.

13. A combination as defined in claim 12, wherein said cup-shaped opening diverges substantially conically toward said cleaning body; and wherein the diameter of said cylindrical end portion of said sleeve substantially corresponds to the smallest diameter of said cup-shaped opening.

* * * * *